United States Patent [19]

Fanselow

[11] 4,237,211

[45] Dec. 2, 1980

[54] PHOTOCHROMIC AZIRIDINE RECORDING MEDIA

[75] Inventor: Dan L. Fanselow, White Bear Lake, MN

[73] Assignee: Minnesota Mining and Manufacturing Company, St. Paul, Minn.

[21] Appl. No.: 973,931

[22] Filed: Dec. 28, 1978

Related U.S. Application Data

[63] Continuation of Ser. No. 811,255, Jun. 29, 1977, abandoned.

[51] Int. Cl.[3] ..... G03C 1/52

[52] U.S. Cl. ..... 430/338; 430/961; 430/962; 430/19

[58] Field of Search ..... 427/248 H, 407 R, 248 H, 427/407 R; 96/67, 90 PC, 90 R, 50 PL; 252/30 O, 300; 430/338, 962, 19, 961

[56] References Cited

U.S. PATENT DOCUMENTS

| | | | |
|---|---|---|---|
| B 283,124 | 1/1975 | Berkes et al. | 96/90 PC |
| 3,042,515 | 7/1962 | Wainer | 96/90 R |
| 3,320,067 | 5/1967 | Taylor | 96/90 PL |
| 3,442,649 | 5/1969 | Rasch et al. | 96/50 PL |
| 3,609,165 | 9/1971 | Heine | 96/90 PC |
| 3,785,820 | 1/1974 | Inoue et al. | 96/90 PC |
| 3,795,529 | 3/1974 | Cartmell et al. | 96/90 PC |
| 3,894,874 | 7/1975 | Schleigh | 96/90 PC |
| 3,984,177 | 10/1976 | Trozzolo | 252/30 O |
| 4,018,604 | 4/1977 | Bachman | 96/67 |

*Primary Examiner*—Won H. Louie, Jr.

*Attorney, Agent, or Firm*—Cruzan Alexander; Donald M. Sell; Gerald F. Chernivec

[57] ABSTRACT

Photochromic aziridines of the formula wherein $R_1$ and $R_2$ taken separately are hydrogen, lower alkyl, phenyl, or ortho or para lower alkyl or lower alkoxy substituted phenyl, and wherein $R_1$ and $R_2$ taken together are alkylene having 4 to 7 carbon atoms, inclusive, are vapor deposited on a substrate, followed by application of a barrier coating which is substantially oxygen-impermeable to thereby provide a thermally stable optically erasable recording medium.

10 Claims, 2 Drawing Figures

PHOTOCHROMIC AZIRIDINE RECORDING MEDIA

This is a continuation, of application Ser. No. 811,255 filed June 29, 1977 now abandoned.

BACKGROUND OF THE INVENTION

This invention relates to recording media which can be imaged by exposure to actinic radiation. More particularly, the invention relates to articles capable of being used for high resolution recording based on the use of photochromic axiridines which allow the image-forming operation to be reversible, i.e. the recorded image may be erased.

Many conventional imaging materials undergo irreversible changes when exposed to actinic radiation. Thus, erasure is impossible without physical destruction of the image itself. Additionally, in many instances, the image formed is latent, and subsequent development is necessary.

Photochromes are compounds which change color reversibly on exposure to actinic radiation. Such direct-developing photochromic materials traditionally suffer the limitation that images produced from systems containing these materials have very little stability, i.e. the image will fade spontaneously within a few minutes or hours at room temperature.

It has now been ascertained that particularly defined photochromic aziridine compounds, vapor coated on a substrate, can be utilized for high resolution, long term recording wherein the recorded image may be erased and information may be added, the film may be re-used, etc. The films can be utilized in data recording applications such as video disc or microfiche, especially in conjunction with high density data recording. Besides being direct developing, such media can be updated or erased. The films can further be used as intermediates in photographic and/or copying processes and as proofing materials.

In Schleigh et al, U.S. Pat. No. 3,894,874, there is described the use of aziridines in photoreductive imaging. A reducible, image-forming compound is combined with the photochromic aziridine in a binder on a substrate to form a radiation-sensitive layer. Upon exposure to actinic radiation, followed by heating, an image may be obtained. Furthermore, partly crystalline and partly crystallographically aligned photochromic aziridines and oxiranes are disclosed as having utility in windshields, sunglasses, and light switching devices in U.S. Pat. No. 3,964,823.

It has now been found that by vapor depositing the hereinafter-defined photochromic aziridines onto a substrate, a high resolution photochromic thin film can be produced. It has further been found that by covering this film with certain materials, the high resolution can be maintained. It has further been found that by utilizing an oxygen barrier material to cover the thin aziridine film, the lifetime of the image formed by exposure to actinic radiation can be increased at least a thousand times more than that of the photochromic aziridine in oxygen or air.

SUMMARY OF THE INVENTION

In accordance with the invention, there is provided a thermally stable optically erasable recording medium comprising a substrate having on at least one surface thereof a vapor deposited, thin, homogeneous film of at least one photochromic aziridine of the formula

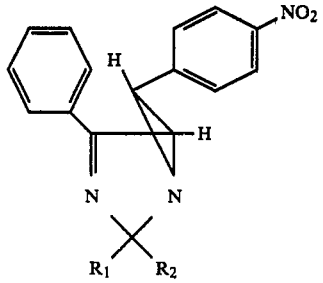

wherein $R_1$ and $R_2$ taken separately are hydrogen, lower alkyl, phenyl, or ortho or para lower alkyl or lower alkoxy substituted phenyl, and wherein $R_1$ and $R_2$ taken together are alkylene having 4 to 7 carbon atoms inclusive, and overlying said film a substantially oxygen-impermeable barrier coating which is reasonably transparent to actinic radiation. Preferably, the film is optically transparent and of a non-dendritic structure.

The medium can be imaged by exposure to actinic radiation, optically erased, and reimaged, with the image being substantially resistant to thermal bleaching.

DETAILED DESCRIPTION OF THE INVENTION

The photochromic aziridines utilized in this invention are $2R_1,2R_2$-6(p-nitropheynl)-4-phenyl-1,3-diazabicyclo[3.1.0]hex-3-enes, which can be structurally designated:

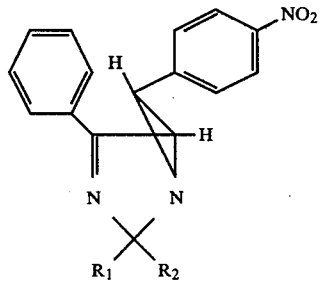

wherein $R_1$ and $R_2$ taken separately are hydrogen, lower alkyl, phenyl, or ortho or para lower alkyl or lower alkoxy substituted phenyl and wherein $R_1$ and $R_2$ taken together are alkylene having 4 to 7 carbon atoms inclusive. (Lower alkyl and lower alkoxy herein signify from one to four carbon atoms.) These compounds can be synthesized by the method disclosed by Heine et al in J. Org. Chem. 32, 2708-10 (1967) and in U.S. Pat. No. 3,609,165. The most preferred compound for this invention is the dimethyl derivative, 2,2'-dimethyl-6(p-nitrophenyl)-4-phenyl-1,3-diazabicyclo[3.1.0]hex-3-ene.

These aziridines are colorless prior to exposure to an electron beam or ultraviolet radiation, but upon exposure, the compounds turn various shades of blue depending upon the $R_1$ and $R_2$ groups contained therein. If such compounds are placed in the dark, they again become colorless; hence, the color change is reversible. Additionally, they may be bleached thermally or by exposure to visible radiation, i.e., they will revert to their colorless condition by use of such methods. Therefore it is known that the colorless form of the photochromic aziridine can be converted to the colored form upon exposure to electron beam or ultraviolet radiation, and the reversible reaction back to the colorless form can occur upon exposure of the aziridine to visible light, or when placed in the dark, or thermally.

This can be depicted by the following:

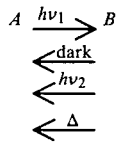

wherein A represents the colorless form, B the colored form, $\nu_1$ is a radiation frequency limited to the ultraviolet, and $\nu_2$ is a radiation frequency limited to the visible.

It has now been ascertained that in the absence of oxygen, the thermal bleaching reaction can be substantially diminished, and the photochromic material can be rendered dark-stable, i.e.

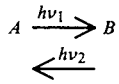

To illustrate this phenomenon, a vapor-deposited film of the dimethyl derivative was coated on a quartz substrate and allowed to stand in air for 24 hours to become slightly turbid, and was then irradiated to yield the deep blue color. The sample was placed in an optical cell in which the atmosphere could be controlled.

Figure 1:
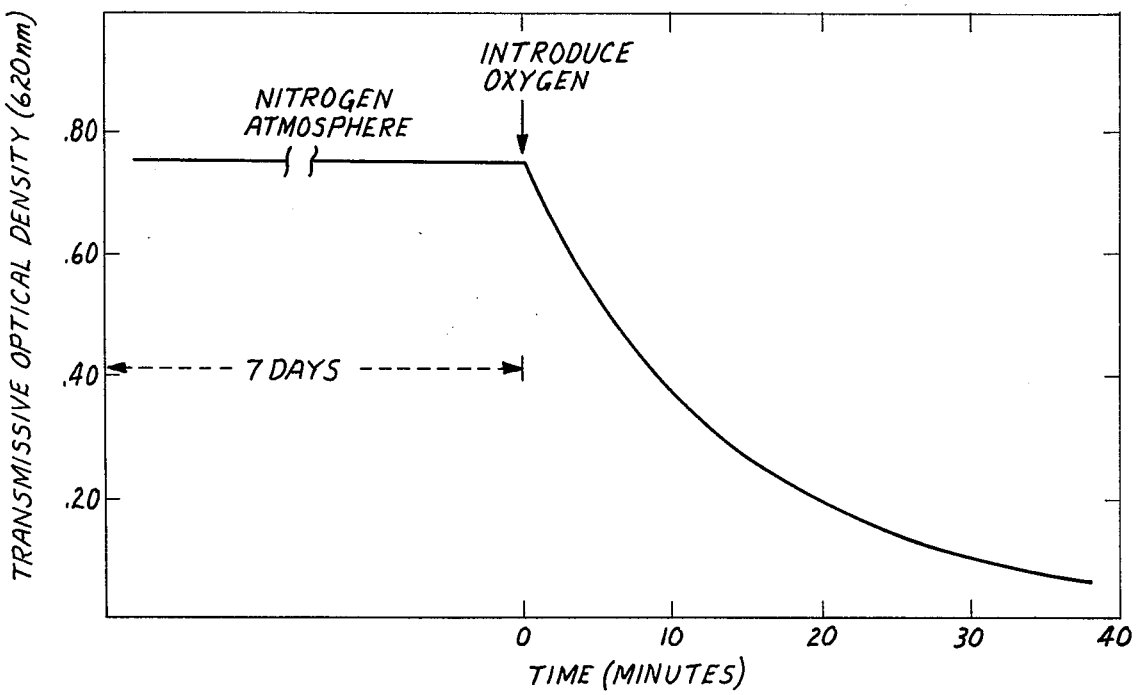

Under a nitrogen atmosphere at room temperature, the transmissive optical density (measured at 620 nm) of the colored film remained essentially constant for seven days; however, upon introduction of oxygen, the color bleached rapidly. These results are shown in FIG. 1.

Figure 2:
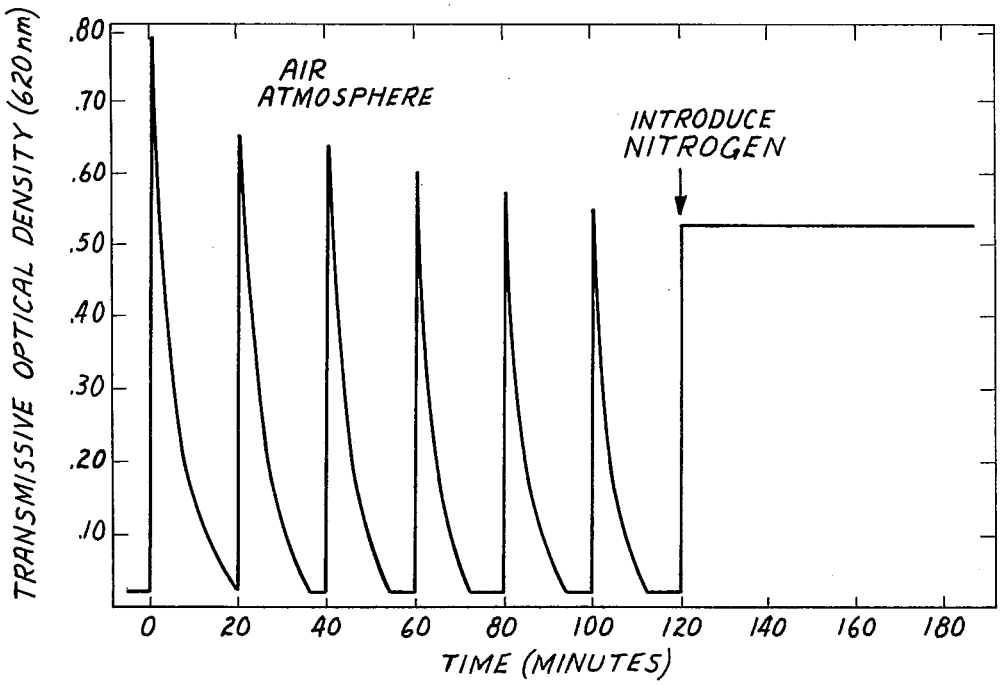

Alternatively, using the same set-up with the film in an air atmosphere, but at 60° C., exposure to ultraviolet radiation caused the film to color practically instantaneously, and then thermally bleach very rapidly. This coloration-bleach cycle was repeated six times, and then the atmosphere was changed from air to nitrogen, still maintaining the temperature at 60° C. Exposure to ultraviolet with the film in the nitrogen atmosphere provided a stable colored form which showed no bleaching over 180 minutes. These startling results are illustrated in FIG. 2.

To further illustrate the results of an oxygen atmosphere on the photochromic compounds, strips of filter paper were saturated with benzene solutions of various aziridines and dried. The strips were then irradiated with ultraviolet to generate the blue form. One set of these irradiated strips was kept in a nitrogen atmosphere in the dark, and another set was kept in an oxygen atmosphere. Both sets were maintained at room temperature in the dark. The time required to bleach to one-half of the original reflective optical density was estimated visually and is recorded in Table I. Considerable care was taken to minimize exposure of the samples to light during the periodic readout.

TABLE I

| Aziridine Derivative | Time Required to Bleach to One-half Optical Density | |
|---|---|---|
| | $O_2$ Atmosphere | $N_2$ Atmosphere |
| $R_1 = R_2 = CH_3$ | 40 minutes | >1 year |
| $(R_1 + R_2)$ = cyclopentyl | 3 hours | >3 months |
| $(R_1 + R_2)$ = cyclohexyl | 10 hours | ~2 months |
| $R_1 = CH_3$, $R_2 = C_6H_5$ | 10 minutes | ~3 months |
| $R_1 = H$, $R_2 = C_3H_7$ | 10 hours | 1 month |
| $R_1 = R_2 = C_2H_5$ | 20 minutes | 3 days |
| $R_1 = CH_3$, $R_2 = CH(CH_3)_2$ | 10 minutes | 3 weeks |
| $R_1 = H$, $R_2 = C_6H_5$ | <10 minutes | 2 days |
| $R_1 = H$, $R_2$ = o-methoxyphenyl | <10 minutes | 15 hours |

It has been further determined, however, that even in an inert atmosphere, such as nitrogen, initially optically clear thin films of the aziridine compounds become turbid or cloudy after a period of time, e.g., 24 hours. It is believed that such a condition is due to crystal growth of the compound.

Initially optically clear films were examined within one hour after deposition with a scanning electron microscope. The resulting micrographs revealed a uniform array of non-crystalline hillocks, less than one micrometer in the longest dimension of the base of the hillocks. A similar sample was stored in nitrogen for 24 hours and underwent a visible change from a transparent film to a turbid film. Scanning electron micrographs of the turbid film revealed that the hillocks had grown substantially and bases of the hillocks were irregular. Many of the hillocks had joined together to form three or more peaks. The regular array had essentially disappeared. Therefore, maintaining a nitrogen, argon, neon, etc. inert atmosphere around the photochromic coating will serve to inhibit thermal bleaching of the colored form, but will not prevent the initially clear film from becoming turbid, which will decrease image resolution. While such a condition is not preferred, even such turbid films have utility as an imaging medium.

It has been found that by utilizing a film-forming barrier coating over the thin aziridine film, which is substantially impermeable to oxygen, the image stability, i.e., resistance to thermal bleaching, and the film transparency, i.e., image resolution capability, can be effectively maintained. Exemplary and preferred materials which are substantially impermeable to oxygen and inert toward the aziridine, i.e., crystal growth inhibiting, such as polyvinyl alcohol or gelatin, applied as thin films over the photochromic film, can effectively prevent crystal growth and also act as an oxygen barrier to minimize bleaching. Imaged films coated with polyvinyl alcohol, for example, have maintained their clarity and image density for periods exceeding one year.

The barrier coating should of course be reasonably transparent to actinic radiation. To minimize crystallization of the photochromic aziridine and therefore turbidity, the barrier coating should be applied as soon after aziridine deposition as possible and before imaging.

Dyes can be added to the barrier coat to select wavelengths that cause coloration of the aziridine. For example, Alizarine Yellow dye can be added to the polyvinyl alcohol coating to minimize background coloration from incandescent room lighting, but still allow imaging with, for example, the 325 nm line from a helium-cadmium laser.

Since moisture will adversely affect the oxygen-barrier properties of polyvinyl alcohol, it would be desirable in a practical recording device to incorporate a radiation transparent moisture barrier either in intimate contact with the article or surrounding it, e.g., films of a copolymer of vinylidene chloride and vinyl chloride.

The temperature of the receiving substrate, for condensation of the photochromic aziridine thereon, is critical. If the substrate is either too cold or too warm, a non-uniform coating deposits and the thin aziridine film will appear to be turbid and/or blotchy. In contrast, a transparent, uniform, homogeneous coating is attained if the temperature of the receiving substrate is about −120° to −140° C.

Scanning electron microscopic examination of the blotchy films at 100× magnification revealed that the aziridine deposits in the form of islands. The clear, transparent films and the turbid films were further examined with scanning electron microscope at 7000× to 10,000× magnification. The micrographs of clear, transparent films illustrated a uniform array of non-particulate hillocks. The valleys between the hillocks were of minimal area compared to the area of the hillocks; and the longest dimension of the hillocks was less than one μm. The thickness of the film was about 0.6 μm. Although the hillocks had rounded tops, the bases of the hillocks were not necessarily round. Some appeared to be oval, ellipsoidal and somewhat irregular, although they were predominantly circular.

The scanning electron micrographs of the turbid films revealed a similar hillock structure, but the hillocks grew together to show an unmistakably dendritic structure. The tree-like structure would have branches of ten to twenty micrometers or more.

The turbid and/or blotchy visual appearance provides light scattering and hence a severe reduction in the resolution of images produced with such films. In contrast, the clear, transparent films provide minimal light scattering and high resolution of images.

The following tables are included for the indicated sublimation conditions, wherein material was deposited on quartz microscope slides. In Table II, the dimethyl aziridine derivative, i.e., wherein $R_1=R_2=CH_3$ was utilized. For Table III, an aziridine wherein $R_1=H$ and $R_2=n\text{-}C_3H_7$ was utilized. In Table IV, the aziridine wherein $R_1+R_2=$cyclohexyl was utilized.

TABLE II

| Bath Temp. | Quartz Receptor Temp. | Time of Deposition | Comments |
|---|---|---|---|
| 140° C. | 25° C. | 2.5 min. | Blotchy, non-uniform films visible; at 100X, islands of deposits are indicated; at 10,000X, dendritic effect is clearly shown. |
| 140° C. | −75° C. | 2.5 min. | Visibly turbid film; at 7000X, dendritic effect predominates. |
| 140° C. | −129° C. | 2.5 min. | Visibly transparent, clear film; at 10,000X, regular array of hillocks less than one μm diameter; film thickness 0.6 μm. |
| 140° C. | −153° C. | 2.5 min. | Visibly turbid film; at 10,000X, extensive dentritic effect. |
| 140° C. | −168° C. | 2.5 min. | Visibly non-uniform, turbid film; at 10,000X, predominant dendritic structure with somewhat larger hillocks. |

TABLE III

| Bath Temp. | Quartz Receptor Temp. | Time of Deposition | Comments |
|---|---|---|---|
| 102° C. | −130° C. | 3 min. | No coating |
| 111° C. | −132° C. | 8 min. | No coating |
| 128° C. | −130° C. | 5 min. | Light uniform film |
| 132° C. | −132° C. | 6.5 min. | Clear, transparent film |
| 131° C. | −169° C. | 6.5 min. | Turbid film with spots |
| 131° C. | 25° C. | 6.5 min. | Non-uniform, turbid coating |

TABLE IV

| Bath Temp. | Quartz Receptor Temp. | Time of Deposition | Comments |
|---|---|---|---|
| 131° C. | −133° C. | 6.5 min. | Light, uniform film |
| 148° C. | −133° C. | 6.5 min. | Clear, transparent film |
| 150° C. | −166° C. | 6.5 min. | Somewhat turbid film with poor adherence to substrate |
| 150° C. | −75° C. | 6.5 min. | Fair film, but poor adherence to substrate |
| 150° C. | 25° C. | 6.5 min. | Film does not adhere to substrate |

From the foregoing tables, it can be seen that the intermediate condensation temperature would appear to be preferably in the range of about −120° C. to about −140° C., at least when the dimethyl derivative is utilized. This condensation temperature, as is indicated in Tables III and IV, may vary somewhat depending on the particular aziridine utilized to form the film.

The receptor substrates utilized in the present invention may be flexible or rigid, and may be reflective, opaque, or transparent. High quality images can be produced on aziridine-coated substrates such as glass, quartz, polycarbodiimide-primed polyester film, tin oxide-coated quartz and glass, and polyester which has been vapor coated with aluminum. The physical properties of the substrate surface will, of course, affect the structure of the thin photochromic film. If, for example, deposition is undertaken on a quartz substrate having rough polishing marks, the striations due to such polishing can be clearly observed on the film.

Readable images may be produced by relatively low intensity ultraviolet exposure. For example, when the dimethyl derivative is utilized, exposure in the range of about 10 to about 20 millijoules/square centimeter (at 325 nm) will produce images having excellent resolution. Readable images can be obtained at an exposure as low as 5 millijoules per square centimeter.

Samples of the photochromic recording media have been made utilizing as substrates Kodak KTFR photoresists and electron beam resists, e.g., epoxidized polybutadiene and polymethylmethacrylate. These substrates were simply vapor coated with photochromic aziridine and subsequently overcoated with polyvinyl alcohol. This construction allows for instant "read-after-write" checking of information in making such articles as video disc masters, where it is desired to record error-correction codes. The construction is also useful in checking image quality in lithographic and printing plates prior to development of the final relief image. The aziridine and polyvinyl alcohol layers can be simply removed along with the unpolymerized resist material following the checking procedure.

The invention will now be more specifically described with the aid of the following non-limiting examples, wherein all parts are by weight unless otherwise specified. In all cases, preparation of the photochromic film was carried out in a laboratory equipped with yellow safe lights to eliminate extraneous ultraviolet radiation.

Sublimations were carried out in a glass laboratory apparatus. The apparatus consists of a heavy-walled outer chamber that can be connected through a three-way stop-clock to a vacuum pump or dry nitrogen or air line. Inside this chamber is a detachable cold finger which can be cooled by passing cold dry nitrogen through its inner walls. The temperature of the cold finger was determined with a thermocouple. The sample to be sublimed was placed in the bottom of the outer chamber and the substrate was attached in intimate contact to the cold finger so as to maximize thermal contact.

EXAMPLE 1

A small amount (0.25 gm) of 2,2'-dimethyl-6(p-nitrophenyl)-4-phenyl-1,3-diazabicyclo[3.1.0]hex-3-ene was placed in the bottom of the sublimation apparatus. A clean, 2 mm thick quartz substrate was firmly attached to the flat cold finger of the sublimation tube with conductive adhesive tape. The apparatus was assembled and evacuated to about 0.15 Torr. Cold dry nitrogen was passed through the jacket of the cold finger until the temperature of the exit gas was steady at about −130° C. At this point, a hot oil bath (140° C.) was utilized to warm the aziridine and sublime it onto the quartz substrate.

Under these conditions, a transparent aziridine film of about 0.6 micron thickness was deposited in two minutes. The oil bath was removed and the cold nitrogen line replaced by a room temperature compressed air line to warm the cold finger rapidly to room temperature. At that point, air was admitted to the chamber and the aziridine-filmed substrate removed. It was optically clear. The substrate was then dipped immediately into a 4 percent by weight aqueous solution of polyvinyl alcohol to provide the oxygen barrier and to prevent further crystal growth of the photochromic aziridine. The substrate was then dried and dipped again to insure a uniform coating of the entire area.

Electron micrographs taken of freshly deposited aziridine films (prior to coating with polyvinyl alcohol) show these to be typically about 0.6 micron thick, and having uniform structure. Films that have been allowed to stand in air or nitrogen (without a polyvinyl alcohol overcoat) change from optically clear to turbid within 24 hours.

A clear, sharp blue image on a colorless transparent background was obtained using 15 millijoules/square centimeter from a Sylvania F4T5/BLB black light when the sample was contact printed using a photographic negative. Following exposure, the sample was stored in the dark in air at room temperature. Over a one year period, the image fidelity has substantially remained. Only on the sample edges, where the polyvinyl alcohol coating thickness decreases, or in blemished coating spots, has the image bleached.

A similar aziridine-filmed substrate was imaged as described above. Then the imaged substrate was placed in a light-tight box which had a window made from an ultraviolet cutoff-visible transmitting filter (Kodak CS-3-69). The box, containing the plate, was set out in sunlight for about one-half hour. The box was subsequently opened in a dark room under yellow light. The image had been completely bleached, i.e., erased. The plate was reexposed with ultraviolet as described before and a clear, sharp image was again obtained. No ghosts were detectable. This process could be repeated over and over without visible loss in quality of the resulting image.

Resolution of the aziridine-filmed quartz plate was determined by recording and then reading out a standing-wave grating. Under yellow safe lights, a fringe pattern was formed by interferring two expanded beams from the 325 nm line of a helium-cadmium laser. The sample was exposed to 17 millijoules per square centimeter. An image of 1020 line pairs per millimeter was recorded. The fact that this grating had been recorded was confirmed by passing a helium-neon laser beam (633 nm) through the imaged sample and observing spots diffracted from the zero order beam. The ratio of intensity of the first order beam to that of the zero order beam was 0.4 percent.

Response time of the polyvinyl alcohol-coated aziridine-filmed quartz plate was determined by measuring the change in its transmittance at 633 nm as a function of time after exposure to a ten nanosecond UV-nitrogen laser pulse (345 nm). The response time to a one millijoule laser pulse (25 millijoules per square centimeter) was less than the 200 nanosecond response time of the photomultiplier tube used to make the measurement. The sample was found to color in less than 200 nanoseconds.

Thermal stability of the exposed blue form was determined in two experiments. In the first, the aziridine-filmed substrate was placed in a special optical sample chamber and kept in 52° C. in air. After ultraviolet irradiation with a Xenon source, absorbance of the 620 nm peak was monitored as a function of time. The sample showed no detectable change in 60 minutes. Films with no polyvinyl alcohol barrier coating bleached completely within 30 minutes.

In a second experiment, one of the samples was imaged and then stored in the dark at room temperature for one year. Only at the edge of the sample, where the barrier layer was thin, was there any noticeable thermal bleaching.

Measurements were made of the rate of optical bleaching of an exposed polyvinyl alcohol-coated photochromic aziridine film by the bleaching action of red (633 nm) light. The previously exposed (blue) sample was placed in the path of an expanded beam from a helium-neon laser. The intensity of that beam at the sample plane was measured with a Gamma Scientific 820A photometer. Small portions of the beam incident on the film and the beam exitting from the film were sampled by means of beam splitters. Thus, the change in transmittance of that beam could be followed as the sample bleached. An exposure of approximately 350 millijoules per square centimeter was required to bleach the sample from a transmissive optical density of 0.65 to one of 0.325.

EXAMPLE 2

Two clean, 2 mm thick quartz substrates were coated with 2,2'-dimethyl-6-(p-nitrophenyl)-4-phenyl-1,3-diazabicyclo[3.1.0]hex-3-ene as described in Example 1. The coated substrates were immediately dipped into a 4 percent by weight aqueous solution of polyvinyl alcohol and dried. The polyvinyl alcohol coating procedure was repeated several times to provide dry polyvinyl alcohol coatings of about 2 μm thickness.

One sample was exposed (in vacuo) to an electron beam for 0.232 seconds having an accelerating potential of 26 kilovolts, a beam current of 10 microamps and a beam area of 2.88 square centimeters (21 millijoules per square centimeter). The sample developed an erasable image which had a transmissive optical density of about 0.5. The second sample was given a 2 second exposure (in vacuo) to an electron beam having an accelerating potential of 165 kilovolts, a beam current of 5 milliamps and beam area of 225 square centimeters (7.3 joules per square centimeter). A high quality image was obtained which was erasable by exposure to visible light.

What is claimed is:

1. A thermally stable, optically erasable recording medium comprising a substrate having on at least one surface thereof a thin, homogeneous, transparent, non-dendritic vapor-deposited film of at least one photochromic aziridine of the formula

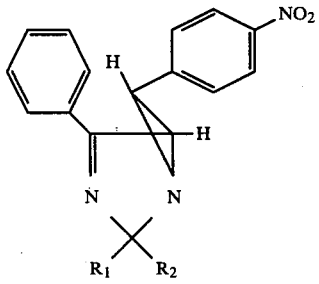

wherein $R_1$ and $R_2$ separately are hydrogen, phenyl, lower alkyl, or ortho or para lower alkyl or lower alkoxy-substituted phenyl or together are alkylene having 4 to 7 carbon atoms; and overlying said film a substantially oxygen-impermeable barrier coating, said coating being reasonably transparent to actinic radiation and capable of inhibiting crystal growth of said aziridine.

2. The recording medium of claim 1 wherein $R_1$ and $R_2$ are methyl groups.

3. The recording medium of claim 1 wherein said barrier coating comprises polyvinyl alcohol.

4. The recording medium of claim 1 wherein said barrier coating comprises gelatin.

5. The recording medium of claim 2 wherein said alkylene is selected from the group consisting of cyclohexyl and cyclopentyl.

6. A process for forming a thermally stable optically erasable recording medium comprising the steps of:

(a) vapor depositing on the surface of a substrate at a temperature of −120° C. to −140° C. a thin, homogeneous, transparent, non-dendritic film of at least one photochromic aziridine of the formula

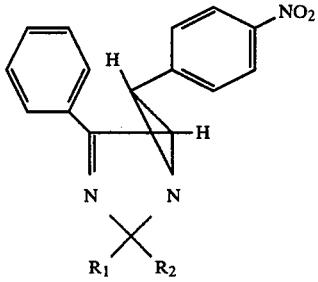

wherein $R_1$ and $R_2$ separately are hydrogen, phenyl, lower alkyl, or ortho or para lower alkyl or lower alkoxy-substituted phenyl or together are alkylene having 4 to 7 carbon atoms;

and (b) applying a substantially oxygen-impermeable barrier coating on said film, said coating being reasonably transparent to actinic radiation, and capable of inhibiting crystal growth of said aziridine.

7. The process of claim 6 wherein $R_1$ and $R_2$ are methyl groups.

8. The process of claim 6 wherein said barrier coating comprises polyvinyl alcohol.

9. The process of claim 6 wherein said barrier coating comprises gelatin.

10. The process of claim 6 wherein said alkylene is selected from the group consisting of cyclohexyl and cyclopentyl.

* * * * *